US005672205A

United States Patent [19]

Fujimoto et al.

[11] Patent Number: 5,672,205

[45] Date of Patent: Sep. 30, 1997

[54] COATING APPARATUS

[75] Inventors: Akihiro Fujimoto; Yasuhiro Sakamoto, both of Kumamoto-ken, Japan

[73] Assignees: Tokyo Electron Limited, Tokyo; Tokyo Electron Kyushu Limited, Tosu, both of Japan

[21] Appl. No.: 533,396

[22] Filed: Sep. 25, 1995

[30] Foreign Application Priority Data

Sep. 29, 1994 [JP] Japan ..... 6-259154

[51] Int. Cl.[6] ..... B05C 11/02; B05B 13/02

[52] U.S. Cl. ..... 118/52; 118/319; 118/320

[58] Field of Search ..... 134/198, 902; 414/935; 141/44, 250, 266, 270, 379, 52; 118/52, 54, 319, 320, 696, 706; 239/140, 149, 159, 160, 164, 165, 170; 222/160

[56] References Cited

U.S. PATENT DOCUMENTS 4,564,280 1/1986 Fukuda ..... 118/321
4,788,043 11/1988 Kagiyama et al. ..... 422/292
5,211,753 5/1993 Swain ..... 118/52

FOREIGN PATENT DOCUMENTS 2-83026 3/1990 Japan .
5-121308 5/1993 Japan .

*Primary Examiner*—Donald E. Czaja
*Assistant Examiner*—Calvin Padgett
*Attorney, Agent, or Firm*—Oblon, Spivak, McClelland, Maier & Neustadt, P.C.

[57] ABSTRACT

According to the present invention, there is provided an coating apparatus including means for holding an object to be process, the object holding means rotating in a state in which the object is placed thereon, a ring-like cup situated on an outer side of the object holding means, processing solution supply means, provided above the object, for supplying a processing solution on a surface of the object, discharge means, provided underneath the ring-like cup, for discharging processing solution portions scattered around when the processing solution is supplied on the surface of the object as a waste solution, together with a gas, and storage means, connected to the discharge means, for storing the waste solution and the gas discharged from the discharge means, wherein the waste solution and the gas are separated from each other in the storage means.

13 Claims, 11 Drawing Sheets

COATING APPARATUS

BACKGROUND OF THE INVENTION

1. Field of the Invention

The present invention relates to an coating apparatus, and more specifically, to a spinner-type coating apparatus which applies processing liquid on a surface of an object to be processed, while the object being held on a spin chuck.

2. Description of the Related Art

An example of the coating apparatus of the above-described type, is a resist coating apparatus for applying resist liquid on a surface of a semiconductor wafer (to be abbreviated as wafer hereinafter) in, for example, a semiconductor manufacture step. A conventional resist coating apparatus will now be described with reference to FIGS. 1 to 4. FIG. 1 is a cross section schematically showing the structure of a conventional resist coating apparatus. FIG. 2 is a characteristic diagram illustrating the rotation speed of the spin chuck while performing a resist application by means of the resist coating apparatus. FIG. 3 is a schematic plan view showing the structure of the resist coating apparatus. FIG. 4 is a schematic side view showing the structural mechanism for mounting the resist nozzle holder detachably on the resist nozzle scan arm in the resist coating apparatus.

In this resist coating apparatus, a spin chuck 202 is provided at a central portion of an inner section of a ring cup 200, and a wafer W is placed on the spin chuck 202. A drop of a resist solution, which is obtained by dissolving a resist into a solvent such as a thinner, is applied from above on the surface of the wafer W via a resist nozzle 204, and a wafer W is rotated by rotating the spin chuck. Thus, the drop of the resist solution is dispersed by the centrifugal force, so as to apply the solution uniformly over the entire surface of the wafer.

During the above-described resist application step, the portion of the resist solution is scattered around. The scattered portion of the resist solution hits the upper portion of the inner wall of the cup 200, and is guided to the bottom of the cup 200 as indicated by a solid line R. Then, the resist solution is sent to a waste solution tank (not shown) from an exhaustion opening 200*a* through a pipe 206. In the cup 200, an exhaustion path 200*b* having a labyrinth structure consisting of an intermediate hanging wall 201 and an intermediate upright wall 203, is provided, and air which is exhausted is guided through an exhaustion path 200*b* to an exhaustion chamber 200C located in an inner side of the cup as indicated by dotted line G, and then sent to an exhaustion pump (not shown) from an exhaustion opening 200*d* of the exhaustion chamber 200*b* through a pipe 208. Further, in order to prevent the resist solution from scattering around the periphery to the rear surface of the wafer during the resist application, a space 215 is provided between the rear surface of the wafer W and the cup 200, and through which space 215, air is allowed to flow from the central portion of the wafer towards the peripheral portion thereof as indicated by a dotted line J.

The spin chuck 202 is rotated by the rotation driving force of the drive motor 210 while holding the wafer W fixedly thereon by a vacuum suction. Usually, after a drop of the resist solution is supplied on the surface of the wafer, the rotation speed of the spin chuck 202 is increased linearly from the still state. The drop of the resist solution is spread over the entire surface of the wafer at a predetermined high speed rotation speed (for example, 4000 rpm), and after a predetermined time elapse, the rotation of the spin chuck 202 is stopped. Therefore, the rotation speed of the spin chuck 202 varies to have the characteristics of a trapezoid-shaped waveform along with a time axis as shown in FIG. 2.

In some cases, the spin chuck 202 is rotated at a low speed (for example, 1000 rpm) from before the dropping of the resist solution on the surface of the wafer, and the speed is switched to a high-speed rotation (4000 rpm) after the dropping of the solution. In such cases, the rotation speed is linearly increased from a low-speed rotation to a high-speed rotation, and therefore the rotation speed is controlled to have substantially the same trapezoid-shaped waveform characteristics as that shown in FIG. 2. The rotation speed of the spin chuck 202, that is, the rotation speed of the drive motor 210, is controlled by a spin chuck rotation control unit 212 under an instruction of a system controller (not shown).

The resist nozzle 204 is connected to a resist supplying unit (not shown) via a resist supplying tube 214. The resist nozzle 204, as shown in FIG. 3, is moved by means of a resist nozzle scan arm 216 between a resist solution discharge position (shown in FIG. 1) set above the spin chuck 202 and a resist nozzle standby unit provided on the outer side of the cup 200.

At the resist nozzle stand-by unit 218*a*, the discharge outlet of the resist nozzle 204 is inserted to an opening 218*a* of a solvent atmosphere chamber, in which the outlet is exposed to the solvent, preventing the resist solution at the tip end of the nozzle from being solidified or deteriorated. Usually, a plurality of resist nozzles 204 are provided, and each nozzle is separately used in accordance with the type of resist solution. For this reason, the resist nozzle scan arm 216 is designed so that each of the resist nozzles 204 is detachably set onto the distal end of the arm in order to move it.

Each of the resist nozzles 204, as shown in FIG. 4, is fixedly held on a plate-like nozzle holder 220. To the nozzle holder 220, the resist supplying tube 214 is set so that it is connected to the resist nozzle 204. Further, a joint member 222 is integrally formed on the nozzle holder 220 so that the holder can be detachably mounted to the resist nozzle scan arm 216. Furthermore, a fixation member 224 is integrally formed on the holder 220 so that the holder can be fixed by engagement to a fixation holding hole 218*a* of the resist nozzle standby unit 218. A pair of holes 222*a* and 222*b* are made in the outer wall surface of the joint member 222 to be located opposite to each other.

A drive mechanism (not shown) is built at a distal end portion 216 of the resist nozzle scan arm 216. With this drive mechanism, nail portions 226*a* and 228*a* of the end portions of a pair of openable tweezers 226 and 228 are inserted to these holes 222*a* and 222*b* for engagement, and therefore the nozzle holder 220 is set to the resist nozzle scan arm 216, thus mounting the resist nozzle 204 to the arm.

In the resist coating apparatus of the above-described type, after the application of the resist solution, a rinse solution is supplied to a peripheral portion of the wafer by means of a rinse nozzle which is different from the resist nozzle, so as to dissolve the resist present on that portion, to be removed (side rinse). As can be seen in FIG. 3, in the conventional apparatus, a rinse nozzle scan arm 230 having a rinse nozzle 230 at its arm distal end portion, is rotated as indicated by an arrow H, and the rinse nozzle 230 is moved between the nozzle standby position located at a side of the cup 200 and a rinse solution discharge position located above the peripheral portion of the wafer W.

In FIG. 1, the drawing of pipes connected to both nozzles 204 and 230 is omitted to facilitate the illustration.

The above-described conventional resist coating apparatus entails the following drawbacks.

First, in the conventional resist coating apparatus, the resist solution (waste solution) and the gas exhausted are separated from each other within the cup 200, and they are discarded from the separate exhaustion openings 200*a* and 200*d*. However, mist of the resist solution is also guided along with the gas exhausted to the exhaustion path 200*b*, and adhered on the wall surfaces 201 and 203. The adhered mist is dried and solidified, stuffing the exhaustion path 200*b* with the resist. In order to avoid this, the exhaustion path 200*b* must be washed frequently with a solvent such as thinner, and therefore the conventional apparatus requires much labor in terms of maintenance and operation.

Second, in the conventional resist coating apparatus, the resist solution is prevented from flowing around the periphery of the wafer and adhering to the rear surface of the wafer by allowing an air flow through the space 215 between the periphery portion of the rear surface of the wafer W and the cup 200 (from the inner side towards the outer side). However, the air of the flow is warmed by the heat of the motor 210 while it is ascending along the side surface of the drive motor 210. Thus, the warmed air hits the peripheral portion of the rear surface of the wafer W, thus heating that portion regionally. As a result, the uniformity of the resist film thickness is lowered.

Third, in the conventional resist coating apparatus, while increasing or decreasing or switching the rotation speed of the spin chuck 202, the speed is controlled so as to have a linear function along with the time axis as can be seen in FIG. 2. For this reason, at points (a, b, c and d) of change in the rotation speed, the acceleration is very high, causing a sliding between the spin chuck 202 and the wafer W. Due to the sliding, particles may be generated.

Fourth, in the conventional resist coating apparatus, as the tweezers 226 and 228 of the resist nozzle scan arm 216 are jointed or connected to the joint member 222 of the nozzle holder 220, the nail portions 226*a* and 228*b* of the tip ends of the tweezers scrape off the holes 222*a* and 222*b* of the joint member 222. The scraping off of the holes creates particles, which may be dropped on the wafer W.

Fifth, in the conventional resist coating apparatus having a structure in which the rinse nozzle 232 used for side rinse is moved by the revolving rinse nozzle scan arm 230, even if there is a slight error in the rotation angle of the arm 230 due to, for example, a backlash within the arm drive mechanism, a large error appears in the distance in the arcing movement of the tip end of the arm. Therefore, it is difficult to position the rinse nozzle 232 accurately at a predetermined rinse solution discharge position. In the case where the rinse nozzle 232 is displaced from the rinse solution discharge position, the precision?? of the side rinse is deteriorated, leaving some resist out on the peripheral portion of the wafer W. This results in that the conveying arm is brought into contact with the resist film when holding the peripheral portion of the wafer W, which scrapes off the resist film portions adhered to the conveying arm, creating the problem of particles.

SUMMARY OF THE INVENTION

The first object of the present invention is to provide an coating apparatus having an improved maintenance characteristic, in which solidification of the processing solution in the cup for collecting the processing solution scattering while supplying the solution to an object to be processed, or stuffing of the member with the solidified solution is prevented.

According to the first object of the present invention, there is provided an coating apparatus comprising: means for holding an object to be process, the object holding means rotating in a state in which the object is placed thereon; a ring-shaped cup situated on an outer side of the object holding means; processing solution supply means, provided above the object, for supplying a processing solution on a surface of the object; discharge means, provided underneath the ring-shaped cup, for discharging processing solution portions scattered around when the processing solution is supplied on the surface of the object as a waste solution, together with a gas; and storage means, connected to the discharge means, for storing the waste solution and the gas discharged from the discharge means; wherein the waste solution and the gas are separated from each other in the storage means.

The second object of the present invention is to provide an coating apparatus, by which the quality of an application film is improved by controlling the temperature of the air flow supplied to the rear surface of the substrate to be processed during the application step, at constant.

According to the second object of the present invention, there is provided an coating apparatus comprising: means for holding an object to be process, the object holding means having drive means for rotating the object holding means in a state in which the object is placed thereon; a ring-shaped cup situated on an outer side of the object holding means; processing solution supply means, provided above the object, for supplying a processing solution on a surface of the object; clean air supply means for allowing cleaning air a temperature of which is adjusted, flow to the ring-shaped cup and a surrounding thereof, in a down-flow manner; cooling-heat insulating means mounted so as to cover at least a part of an outer side surface of the drive means; and cleaning air guide means for allowing the cleaning air to flow from an outer side of the ring-shaped cup to an inner side of the ring-shaped cup through an underneath portion of the ring-shaped cup, so as to supply the cleaning air to a rear surface of the object placed on the object holding means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
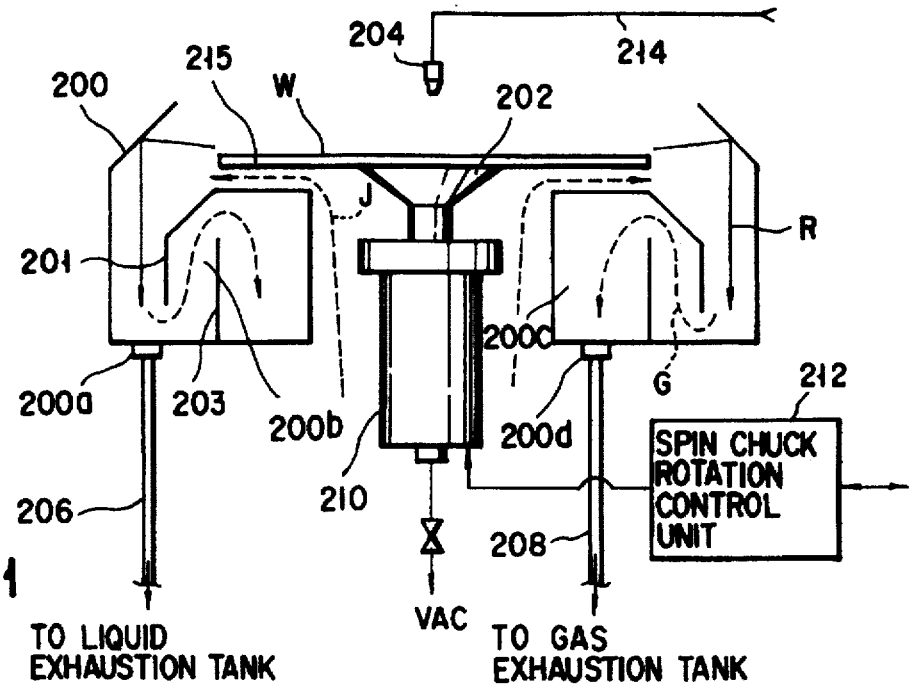
FIG. 1 PRIOR ART
FIG. 1 is a schematic cross section showing an entire structure of a conventional resist coating apparatus.
Figure 2:
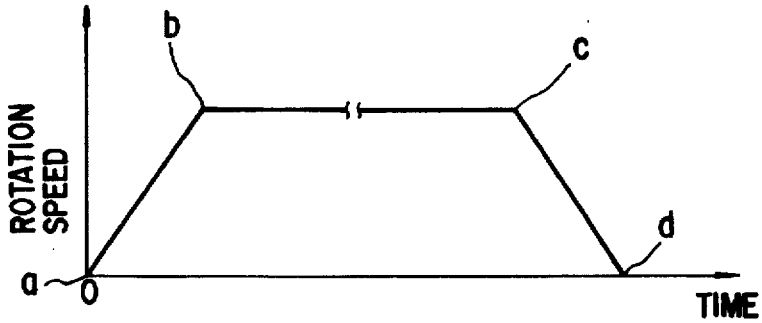
FIG. 2 PRIOR ART
FIG. 2 is a diagram designed to describe the speed control of the spin chuck in the conventional resist coating apparatus shown in FIG. 1.
Figure 3:
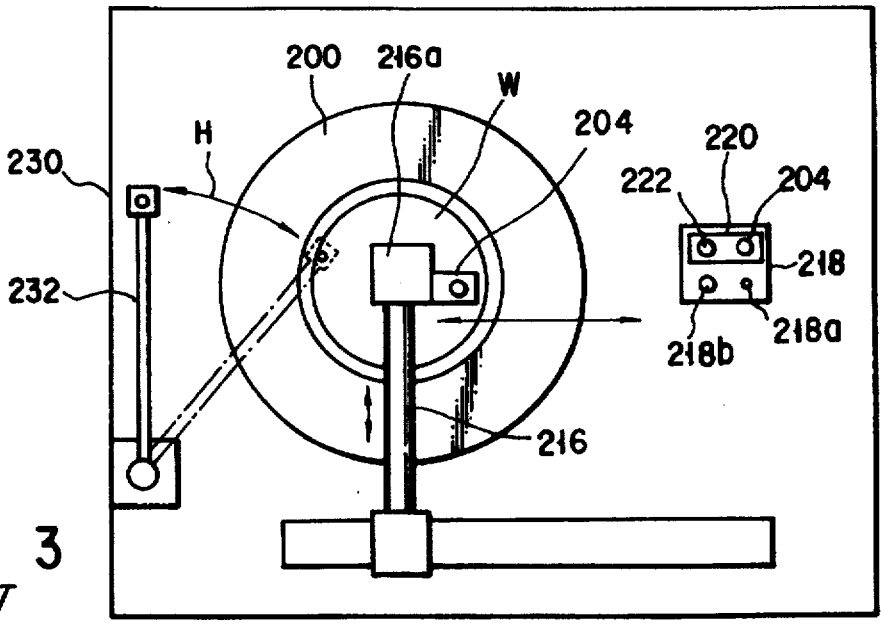
FIG. 3 PRIOR ART
FIG. 3 is a schematic plan view showing the structure of the conventional resist coating apparatus shown in FIG. 1.
Figure 4:
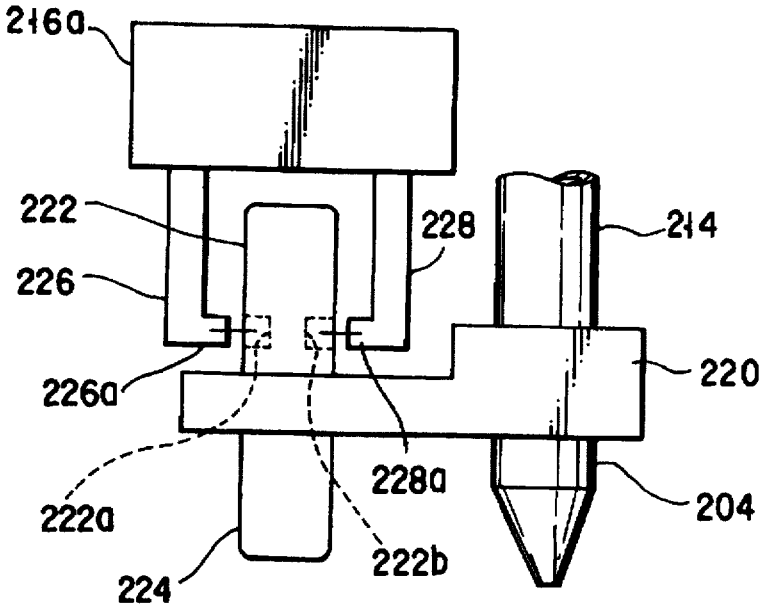
FIG. 4 PRIOR ART
FIG. 4 is a side view showing the structure of a joint mechanism between the resist nozzle scan arm and the nozzle holder in the conventional resist coating apparatus shown in FIG. 1.

In the coating apparatus according to the first aspect of the present invention, the separation of the waste solution and the gas exhausted is not carried out in the ring-shaped cup, and the waste solution and the gas exhausted are sent together via exhaustion means to storage means, in which the waste solution and the exhaustion gas are separated from each other by gas-solution separation means. With this constitution, the waste solution is prevented from being solidified in the cup, and therefore the stuffing up of the system or the like can be suppressed.

In the coating apparatus according to the second aspect of the present invention, cleaning air having a constant temperature and supplied in a down-flow manner, detours from the outer side of the cup around the underneath area of the cup, to the inner side thereof, and after ascending a region close to the driving means, the cleaning air flows along the rear surface of the object from the inner side of the substrate towards the outer side. At this time, due to the cooling or heat insulating effect of cooling-heat insulating means provided so as to cover at least a part of the outer side surface of the driving means, the cleaning air is supplied to the rear surface of the object while maintaining its temperature substantially at constant, without being warmed by the heat of the drive means when the air flows near the drive means. With this constitution, the object is not heated by the air flow which hits the rear surface of the object, thus achieving a high quality application film.

The coating apparatus of the present invention includes means for controlling the rotation of the object holding means, which curvedly changing the rotation speed along with the time axis when changing the rotation speed of the object holding means. Therefore, when changing the rotation speed of the object holding means, for example, while increasing the rotation speed, the rotation speed is changed curvedly along the time axis, for example, in an S-shaped manner. Consequently, the stress created between the object holding means and the object is relaxed, or the sliding therebetween can be avoided, thus preventing the generation of particles.

Further, in the coating apparatus of the present invention, a recess portion is formed on an upper surface of the processing solution supply means holder for holding processing solution supplying means, and the first joint portion is provided in this recess portion. Further, a tweezer member having the second joint portion which can be jointed to the first joint portion in the recess portion, the tweeze member being capable of entering/exiting the recess portion of the processing solution supply means holder in the vertical direction, is provided for the processing solution supplying means conveying means for moving the processing solution supplying means between the standby position and the processing solution discharge position set above the object holding means. With this structure, even if particles are created due to friction when the second joint portion of the tweezer member of the processing solution supply means conveying means is attached to or detached from the first joint portion of the recess portion of the solution, such particles are captured within the recess portion, thus preventing the particles from scattering around. As a result, the creation of particles between the processing solution supplying means and the processing solution supplying means conveying means can be prevented.

Furthermore, in the coating apparatus of the present invention, there are provide a movable arm for supporting the processing solution supplying means and arm driving means for translationally moving the arm in order to move the processing solution supplying means between the standby position and the processing solution discharge position set above the object on the object holding means. With this structure, the processing solution supplying means is moved by translationally moving the arm. Therefore, even if the moving distance of the arm contains an error due to a backlash or the like in the driving mechanism, an error which is larger than the error contained in the moving distance is not caused in the position of the processing solution supplying means, thus achieving a position of the processing solution supplying means at the processing solution discharge position at a practically sufficient accuracy. Therefore, it is rendered possible to hit the processing solution at the peripheral portion of the object for an accurate width, improving the processing accuracy.

With regard to the coating apparatus of the present invention, examples of the object are a wafer, an LCD (liquid crystal device) substrate, a CD, a hard disk and ceramic substrate, and examples of the processing solution are a resist solution and magnetic solution. Further, an example of the object holding means is a type in which a processing solution is spread over the surface of an object by a centrifugal force created while rotating the object on a spin chuck or the like. Furthermore, an example of the processing solution supplying means is a nozzle.

Figure 5:
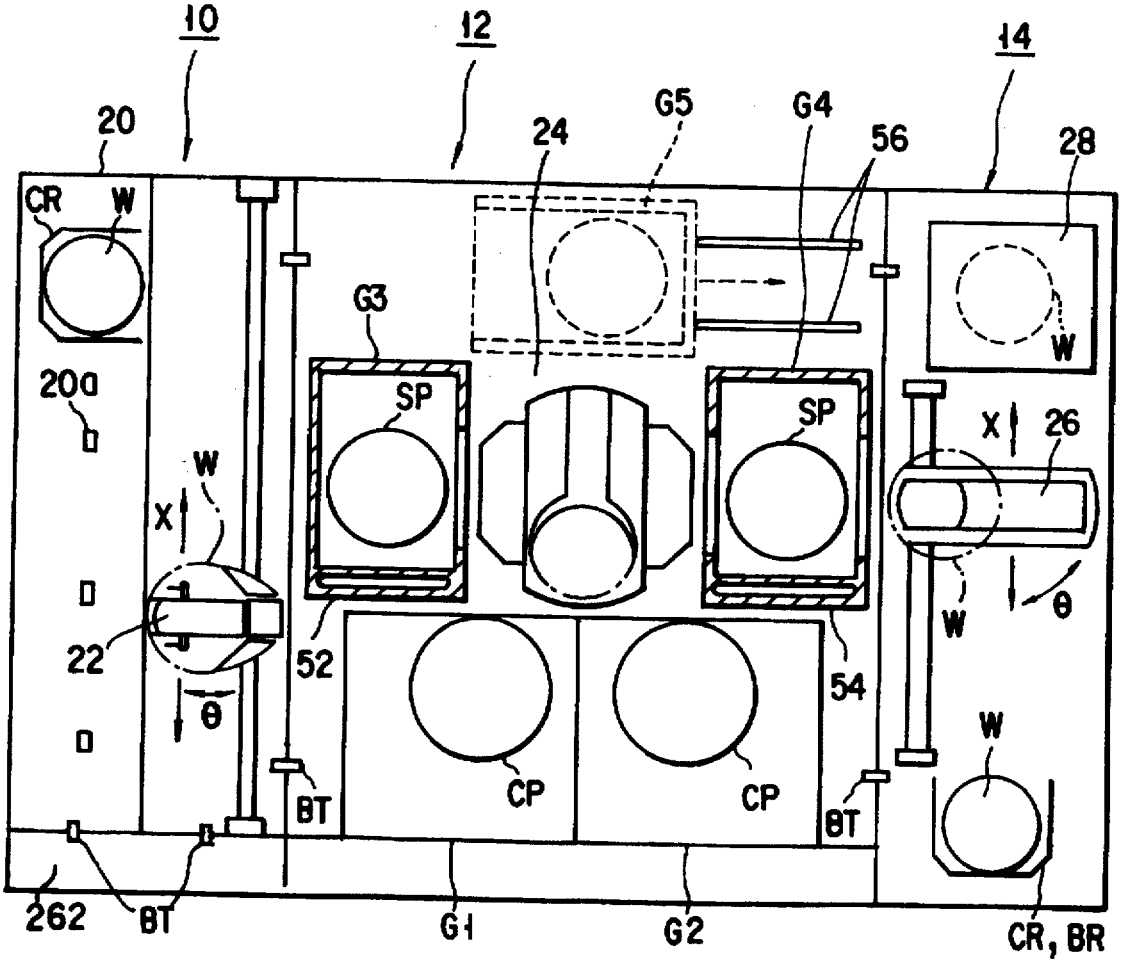
FIG. 5 is a plan view showing the entire structure of the application development process system including a resist application unit (apparatus) according to an embodiment of the present invention.
Figure 6:
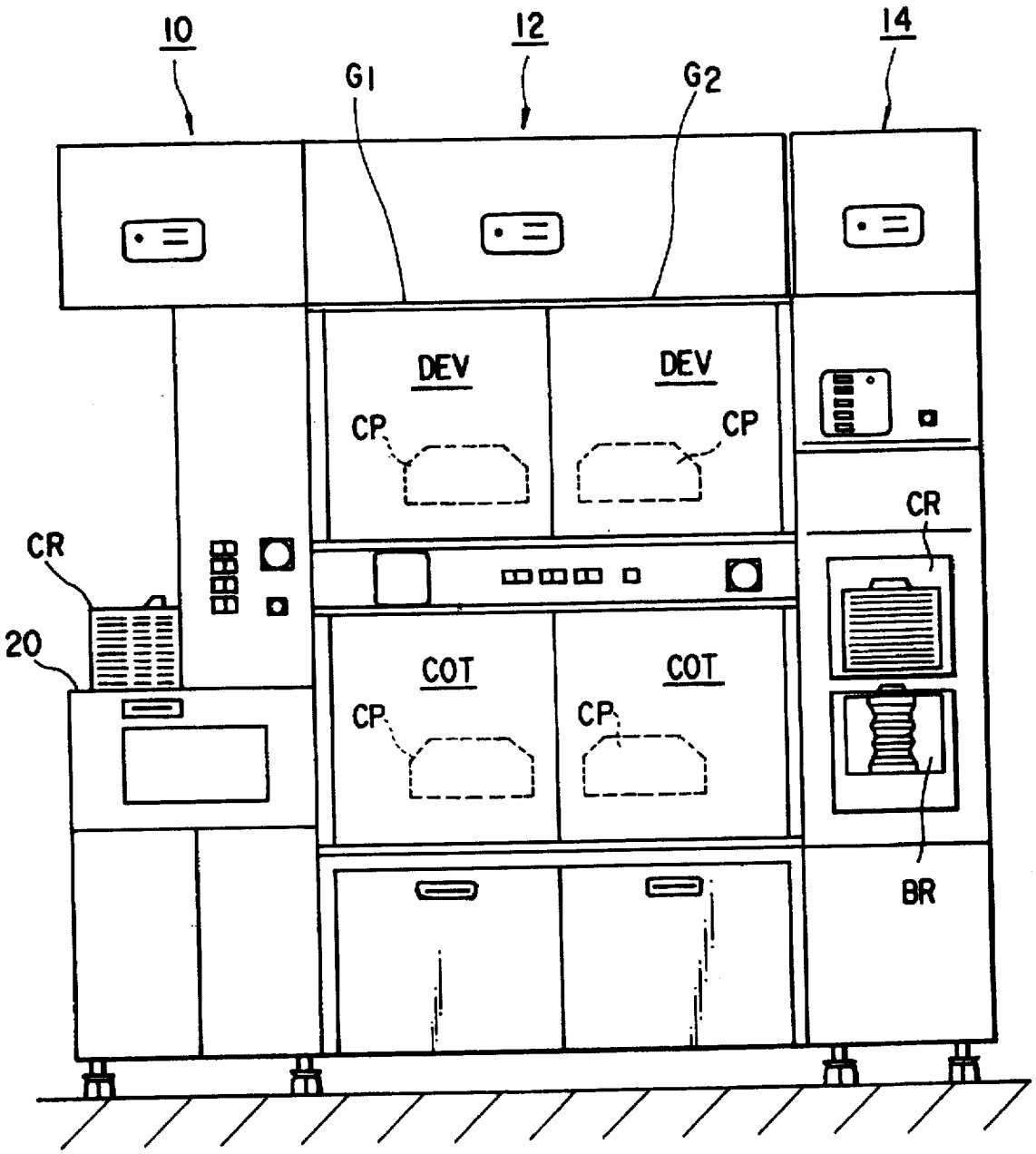
FIG. 6 is a front view showing the structure of the application development processing system shown in FIG. 5.
Figure 7:
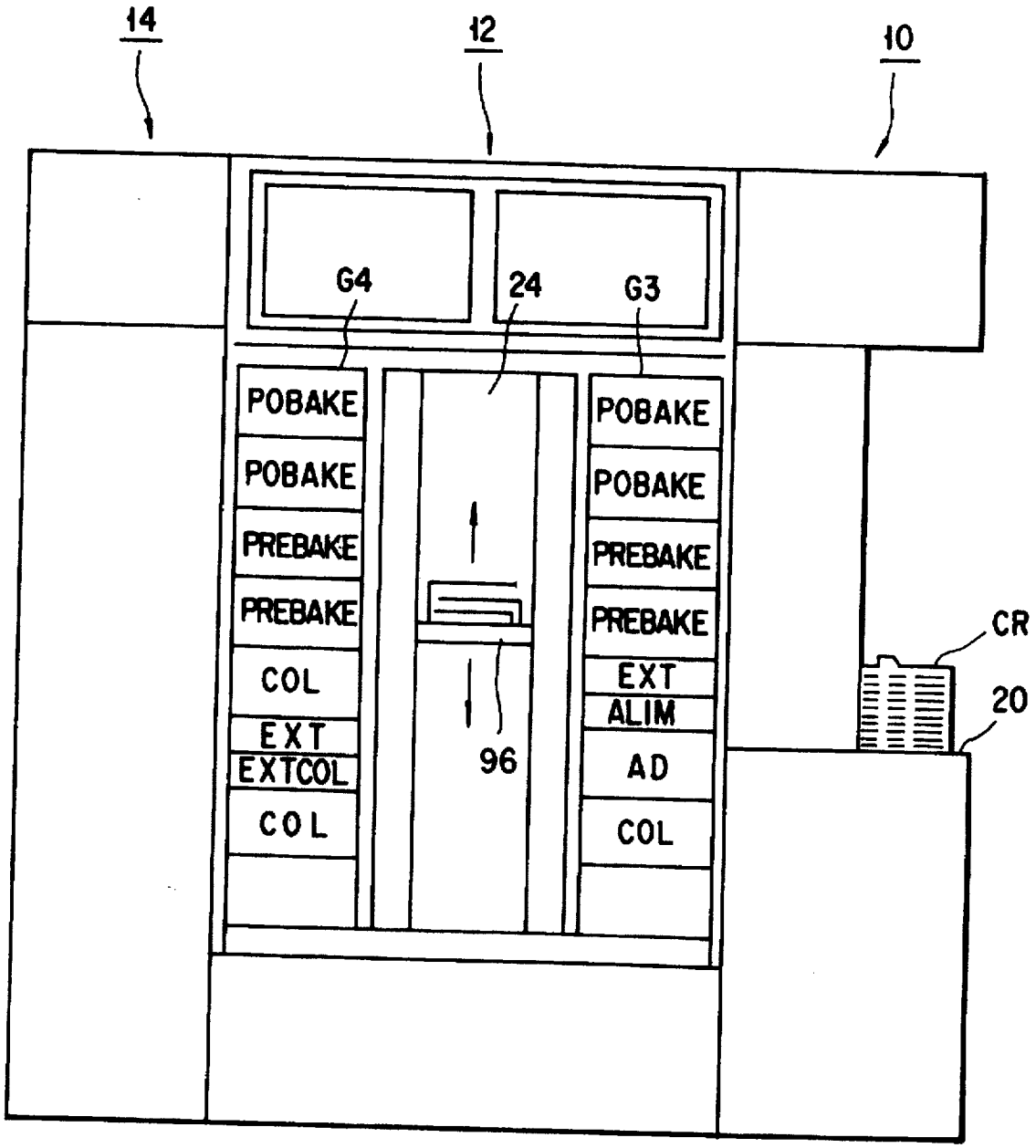
FIG. 7 is a rear view showing the structure of the application development processing system shown in FIG. 5.

An embodiment of the present invention will now be described with reference to FIGS. 5 to 16B. First, with reference to FIGS. 5 to 9, an application development processing system including a resist coating apparatus, which is an embodiment of the present invention, will now be explained. FIGS. 5 to 7 are diagrams showing an entire structure of an application development processing system. FIG. 5 is a plan view thereof, FIG. 6 is a front view thereof and FIG. 7 is a rear view.

This processing system has a structure in which a cassette station 10 for loading or unloading a plurality of wafers W which are objects, for example, in the unit of 25, by means of wafer cassettes CR, and for loading or unloading wafers W on/from a wafer cassette CR, a processing station 12 in which various one-by-one type processing units each carrying out a predetermined process on wafers W one by one in the application development step are provided stepwise at predetermined positions, and an interface portion 14 for passing or receiving wafers W with respect to an exposure device (not shown) located adjacent to the processing station 12, are integrally connected.

In the cassette station 10, as shown in FIG. 5, a plurality of, for example, up to 4 wafer cassettes CR, are placed at positions of projections 20a on a cassette placement base 20 in one line in an X direction with each wafer inlet/outlet facing the processing station 12. A wafer conveying means 22 movable in the cassette arrangement direction (X direction) and in the wafer arrangement direction (Z vertical direction) for wafers loaded in a wafer cassette CR, is designed so as to be able to selectively access to each wafer cassette CR. Further, the wafer conveying member 22 is designed so as to be rotatable in the θ direction, and can access to an alignment unit (ALIM) and an extension unit (EXT) which belong to a multi-story unit portion of the third group G3 on the process station 12 side, as will be described later.

In the processing station 12, as can be seen in FIG. 5, a main wafer conveying mechanism 24 of a vertical conveying type is provided at the center portion thereof. Around the mechanism 24, all the processing units are provided multi-storied in one group or a plurality of groups. An example thereof is a multi-story arrangement structure of five groups G1, G2, G3, G4 and G5. More specifically, a multi-story unit of the first and second groups G1 and G2 is juxtaposed in the front side of the system (foreground side in FIG. 5), a multi-story unit of the third group G3 is placed adjacent to the cassette station 10, a multi-story unit of the fourth group G4 is placed adjacent to the interface portion 14, and a multi-story unit of the fifth group G5 is placed on the rear side of the system.

As can be seen in FIG. 6, in the first group G1, a resist application unit (COT) and a development unit (DEV) according to the present embodiment as a spinner-type processing unit for carrying out a predetermined process while a wafer W being placed on the spin chuck in the cup CP, are placed one above another in two stories from below in the order. Similarly, in the second group G2, a resist application unit (COT) and a development unit (DEV) according to the present embodiment are placed one above another in two stories from below in the order. In the resist application unit (COT), the process of the waste of the resist solution is very much laborious in terms of not only mechanism but also maintenance, and therefore it is preferable that the resist application unit (COT) should be placed in a lower story. It should be noted that the resist application unit (COT) can be placed at a higher story in accordance with necessity.

As can be seen in FIG. 7, in the third group G3, oven-type processing units for carrying out predetermined processes on a wafer W placed on a stage SP, for example, a cooling unit (COL), an adhesion unit (AD), an alignment unit (ALIM), an extension unit (EXT), pre-baking units (PREBAKE) and post-baking units (POBAKE) are placed one on another in eight stories the in the order from below. Similarly, in the fourth group G4, oven-type processing units, for example, a cooling unit (COL), an extension-cleaning unit (EXTCOL), an extension unit (EXT), a cleaning unit (COL), pre-baking units (PREBAKE) and post-baking units (POBAKE) are placed one on another in eight stories the in the order from below.

As described above, the cleaning unit (COL) and the extension-cooling unit (EXTCOL) which have low processing temperatures are placed in lower stories, whereas the baking units (PREBAKE), the post-baking units (POBAKE) and the adhesion unit (AD) are placed in higher stories, thus lowering the thermal interference between units. It should be noted that units having low processing temperatures and units having high processing temperatures can be arranged at random in stories in accordance with necessity.

The interface portion 14 has the same measurements as those of the processing station 12 in terms of its depth direction, and has a smaller measurement than that of the processing station 12 in its width direction. On the front side of the interface portion 14 (the bottom side in FIG. 5), a portable pick-up cassette CR and a stationary buffer cassette BR are arranged in two stories. On the rear surface side (the upper side of FIG. 5), a periphery exposure device 28 is provided, and at the center portion, a wafer conveying member 26 is provided. The wafer conveying member 26 is designed to move in the X and Z directions so as to access both cassettes CR and BR and the periphery exposure device 28. Further, the wafer conveying member 26 is formed rotatable in the θ direction so as to be able to access the extension unit (EXT) which belongs to the multi-story unit of the fourth group G4 on the processing station 12 side, and also a wafer transfer stage (not shown) located adjacent thereto.

Figure 8:
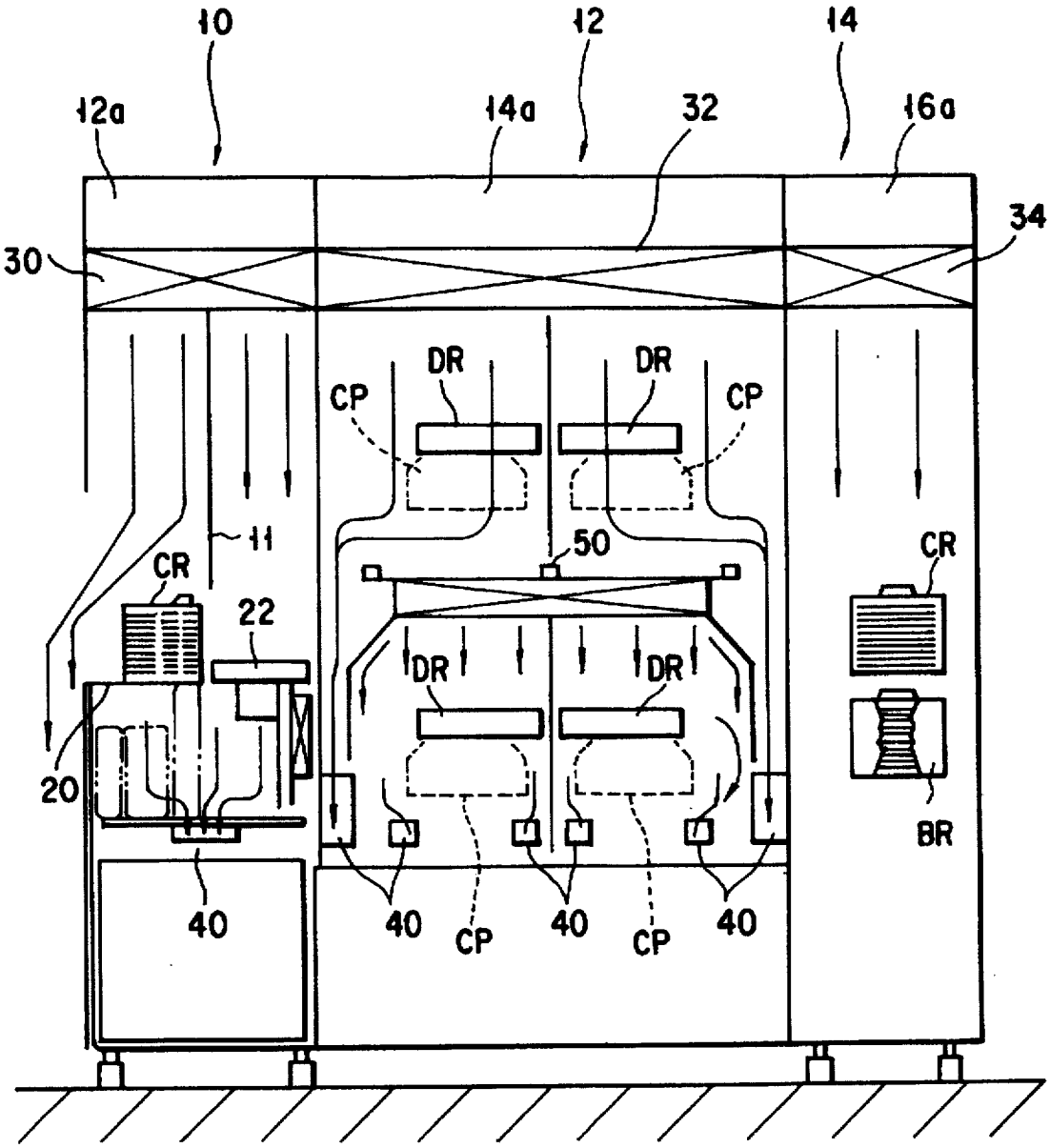
FIG. 8 is a schematic front view illustrating the flow of the cleaning air in the application development processing system shown in FIG. 5.
Figure 9:
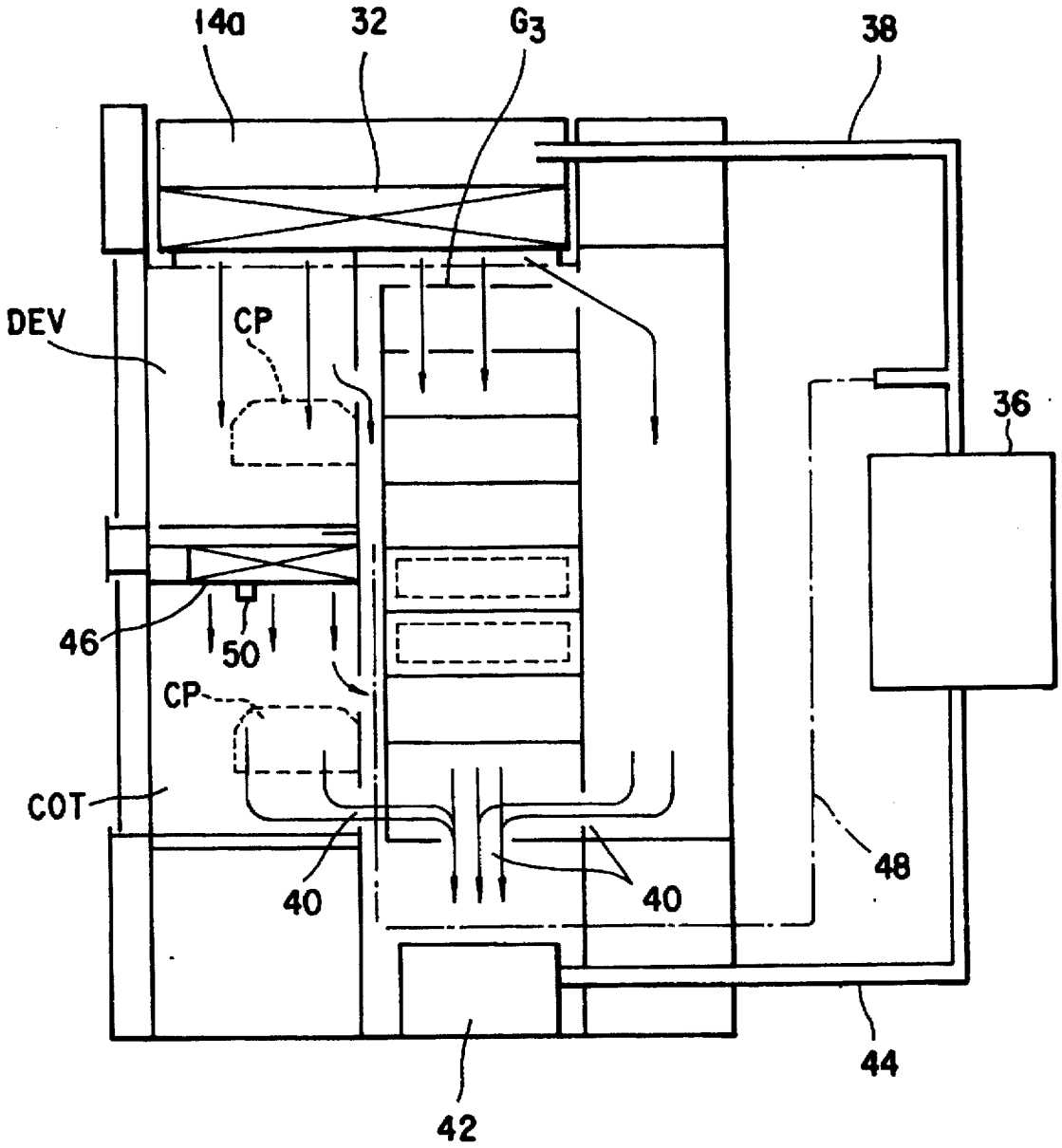
FIG. 9 is a schematic side view illustrating the flow of the cleaning air in the application development processing system shown in FIG. 5.

The processing system is provided in a clean room, and also within the system, the degree of cleanness of each member is increased by a high efficiency vertical layer flow mode. FIGS. 8 and 9 show flows of clean air in the system.

As can be seen in FIGS. 8 and 9, above the cassette station 10, the processing station 12 and the interface portion 14, air supply chambers 12a, 14a and 16a are provided. On the lower surfaces of these air supply chambers 12a, 14a and 16a, filters with dust-proof function, for example, ULPA filters 30, 32 and 34 are mounted.

As shown in FIG. 9, outside or in the back of the present processing system, an air conditioner 36 is provided. Air is introduced from the air conditioner 36 to the air supplying chambers 12a, 14a and 16a via a pipe 38. Clean air is supplied from the ULPA filters 30, 32 and 34 of the air supplying chambers to the members 10, 12 and 14 in down flow. The down flow air is guided to an exhaustion opening 42 provided at the bottom, via a number of ventilation holes provided at appropriate sections in the lower portion of the system, and thus the air is collected from the exhaustion opening 42 via the pipe 44 into the air conditioner 36 so as to be circulated. It is also possible that the air is discharged to the outside from the exhaustion opening 42 without being circulated. Note that, as can be seen in FIG. 8, in the cassette station 10, a space above the cassette placement base 20 and a space in which the wafer conveying arm 22 is moved, are separated from each other by a hanging-wall type partition plate 11, thus the down flows of the air in these spaces being different from each other.

As shown in FIGS. 8 and 9, in the processing station 12, a ULPA filter 46 is provided on a ceiling surface of the resist application unit (COT) provided at a lower story of the multi-story unit of the first and second groups G1 and G2, and the air from the air conditioner 36 is sent to the filter 46 via a pipe 48 branched from the pipe 38. In the middle of the pipe 48, a temperature-humidity controller (not shown) is provided so that clean air having a predetermined temperature and a predetermined humidity, suitable for the resist application step, can be supplied to the resist application unit (COT). Further, a temperature-humidity sensor 50 is provided near the flow-out side of the filter 46. An output from the sensor is supplied to the control portion of the temperature-humidity adjuster, and the temperature and humidity of the clean air are accurately controlled by a feedback mode.

In FIG. 8, an opening portion DR through which a wafer and the conveying arm are allowed to pass, is provided on the side walls of the spinner-type processing units (COT) and (DEV) which face the main wafer conveying mechanism 24. Each opening DR has a shutter (not shown) mounted thereto, so that particles or contaminant are not allowed to enter the main wafer conveying mechanism 24.

In the application development processing system of the structure, wafers W are conveyed, for example, as follows in order to carry out the processes. First, wafers W before the process are unloaded one by one from a wafer cassette CR by means of the wafer conveying member 22, and each wafer W is loaded to an alignment unit (ALIM). Then, a wafer W which has been aligned is unloaded by means of the main wafer conveying mechanism 24, and loaded to the adhesion unit (AD), where the wafer W is subjected to an adhesion process. After completion of the adhesion process, the wafer W is unloaded by the main wafer conveying mechanism 24, and conveyed to the cooling unit (COL), where the wafer W is cooled. Next, the wafer W is sent to the resist application unit (COT), the prebaking unit (PREBAKE) and the extension cooling unit (EXTCOL), in each of which the wafer is subjected to each predetermined process, and then the wafer W is conveyed via the interface portion 14 to the exposure device. After the wafer W is subjected to the exposure process, the wafer W is conveyed to the extension unit (EXT), the development unit (DEV) and the post-baking unit (POBAKE) of the fourth group G4, the extension unit (EXT) of the third group G3 and the like, in each of which a certain process is carried out, and the wafer W which has been subjected to various processes, is conveyed and loaded to a wafer cassette CR.

Figure 10:
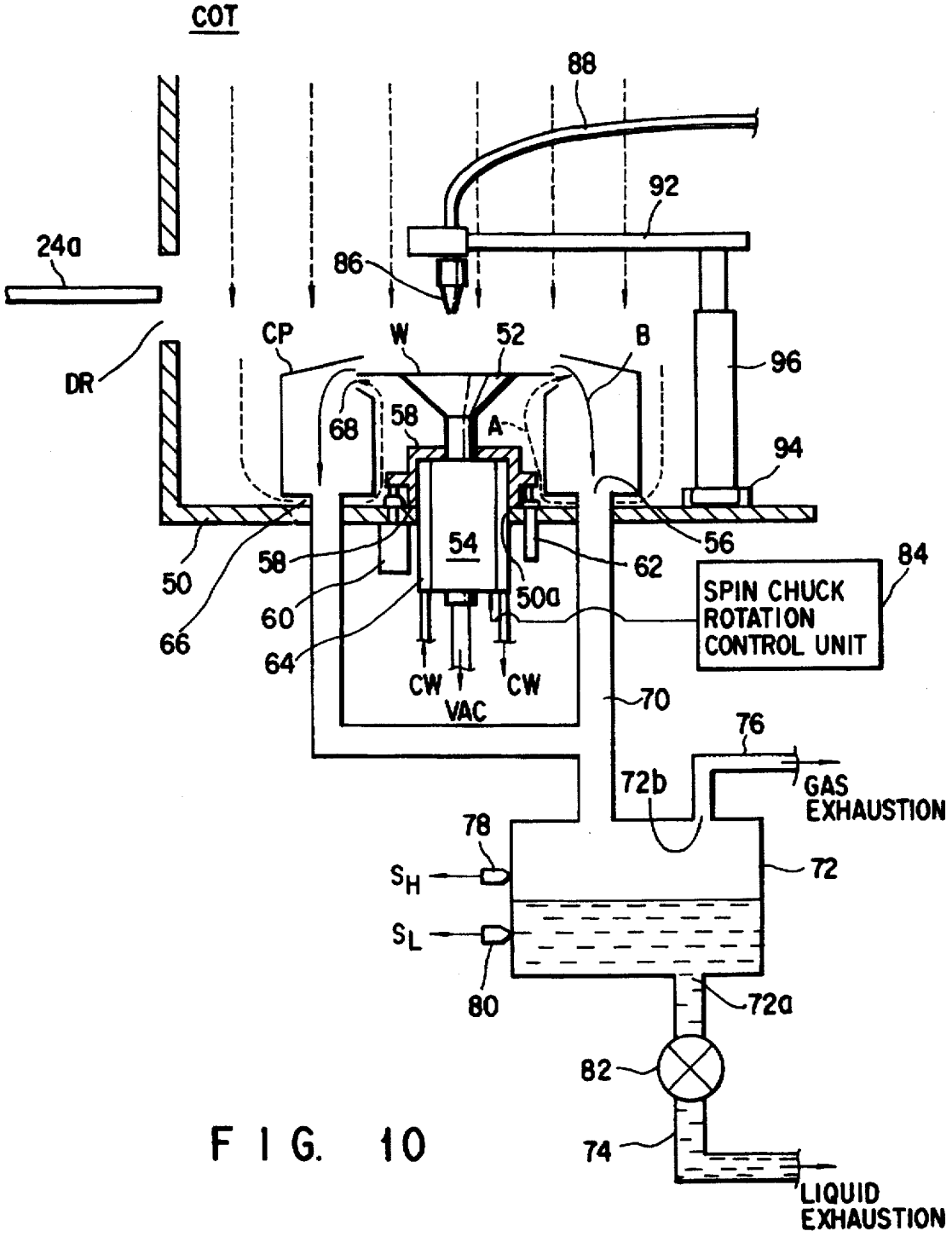
FIGS. 10 and 11 are schematic plan views showing an entire structure of the resist application unit in the embodiment of the present invention.
Figure 11:
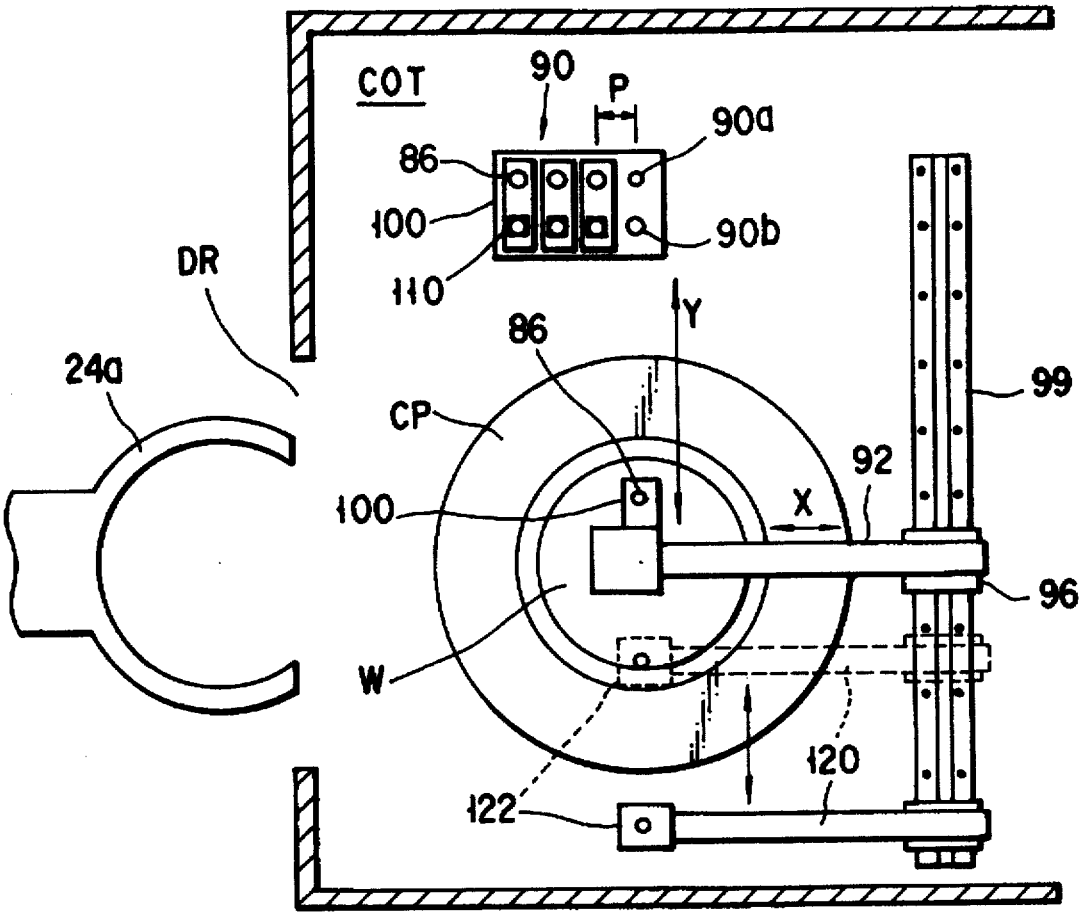
Figure 12:
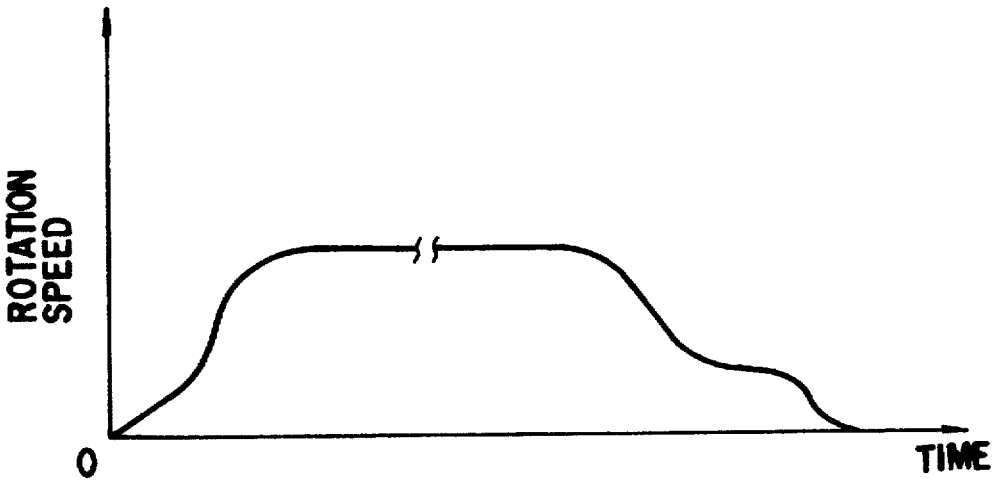
FIG. 12 is a diagram illustrating an example of the speed control of the spin chuck in the resist application unit of the embodiment of the present invention.

Next, the resist application unit (COT) in the present embodiment will now be described with reference to FIGS. 10 to 16B. FIGS. 10 and 11 are schematic cross section and plan view, respectively, showing an entire structure of the resist application unit (COT).

In the resist application unit (COT), a ring-shaped cup CP is provided at a central portion of the bottom of the unit, within which a spin chuck 52 is provided. The spin chuck 52 is designed so that it is rotated by the rotation driving force of the drive motor 54 serving as driving means, while fixedly holding a wafer W by vacuum suction. The drive motor 54 is provided ascendable/descendable at an opening 50*a* provided in the unit bottom plate 50, and is coupled with ascending/descending drive means 60 made of, for example, an air cylinder and ascending/descending guide means 62 via a cap-like flange member 58 made of, for example, aluminum. On the side surface of the drive motor 54, a cylindrical cooling jacket 64 made of, for example, SUS, is mounted, and the flange member 58 is mounted so as to cover the upper half portion of the cooling jacket 64.

At the time of the resist application, as can be seen in FIG. 10, a lower end 58*a* of the flange member 58 is tightly attached to the unit bottom plate 50 at the outer periphery of the opening 50*a*, thus sealing the unit. When a wafer W is transferred between the spin chuck 52 and the tweezers 24*a* of the main wafer conveying mechanism, the drive motor 54 and the spin chuck 52 are lifted up by the ascending/descending drive means 54, and therefore the lower end of the flange member 58 is separated above from the unit bottom plate 50. In the cooling jacket 64, a water path for allowing cooling water to flow therethrough, is provided in the cooling jacket 64, and the cooling water CW the temperature of which is adjusted to a constant level is circulated within the jacket from the cooling water supply portion (not shown).

Between the lower surface of the cup CP and the unit bottom plate 50, a space 66 is provided. In the unit, cleaning air the temperature and humidity of which are controlled to be constant, is supplied in a down-flow manner from the ULPA filter 46 to the ceiling as described above. The cleaning air which hits the unit bottom plate 50 around the cup CP proceeds through a gap 66 underneath the cup CP to the inner side of the cup CP. In the resist application, the lower end 58*a* of the flange 58 is tightly attached to the unit bottom plate 50 near the periphery of the opening 50*a* so as to seal the unit, and therefore the cleaning air which has passed the space 66 to reach the inner side of the cup CP, ascends along the side surface of the flange member 58 as indicated by dotted line A, and enters the cup CP through the space 68 between the periphery of the wafer W and the cup CP. Thus, as the air flows through the space 68 from the inner side to the outer side, the resist solution is prevented from scattered around the edge and reaching the rear surface of the wafer.

The heat generated from the drive motor 54 is quickly absorbed by the cooling jacket 64, and the flange member 58 covers around the cooling jacket 64, and therefore the cleaning air which has passed the space 66 and flowed to the inner side of the cup CP, is not warmed while it is passing near the drive motor 54. The cleaning air from the ULPA filter 46 of the ceiling detours underneath the cup CP while maintaining the temperature and the humidity substantially at constant, and reaches the space 68. Consequently, the peripheral portion of the wafer W is not warmed by the air flow on the rear surface side, and thus the uniformity of the resist film is guaranteed.

In the cup CP, a chamber is defined by the outer peripheral wall surface, the inner peripheral wall surface and the bottom surface, and a drain opening 56 (or a plurality of them) is provided. The drain opening 56 is connected to a tank 72 via a drain pipe 70. The tank 72 is a sealed container, on a bottom surface of which a waste solution opening 72*a* is provided, on an upper surface of which an exhaustion opening 72*b* is provided, and these openings are connected to a waste solution processing unit (not shown) and an exhaustion pump (not shown) via pipes 74 and 76, respectively. Outside the tank 72, solution surface sensors 78 and 80 for detecting a liquid surface in the tank, are set at positions of predetermined heights.

In the resist application, the resist solution portions scattered around from the wafer W are collected in the cup CP as indicated by a solid line B, and sent as a waste solution from the drain opening 56 at the bottom of the cup CP through the drain pipe 70 to the tank 72. At the same time, the air present in the cup CP is also discharged as a waste gas from the drain opening 56 together with the waste solution. In the tank 72, a solvent such as thinner is provided via a pipe which is not shown, and the resist is temporarily stored in the tank in the form of a liquid without being solidified. When the liquid surface in the tank 72 rises up to the upper limit position, a control circuit (not shown) opens an open/close valve 82 of the pipe 74 in response to an output signal SH from the solution surface sensor 78, whereas when the liquid surface in the tank 72 lowers down to the lower limit position, the control circuit closes the open/close valve 82 in response to an output signal SL from the solution surface sensor 80. Thus, the waste solution from the cup CP is sent to the waste solution processing portion via the pipe 74 after being temporarily stored in the tank 72. In the meantime, the gas sent to the tank 72 is discharged from the exhaustion opening **72*b* via the pipe 76** to the exhaustion pump side.

As described above, in the resist application unit according to the present embodiment, the separation of the solution and air is not performed in the cup CP, but the waste solution and the air are sent together from the cup CP via the common exhaustion opening 56 and the common drain pipe 70 to the tank 72, in which the separation of the waste solution and the air (liquid-gas separation) is carried out. The resist solution portions sent from the cup CP are sucked by the negative pressure on the tank 72 side and vigorously fall into the solvent in the tank 72 by the effect of the centrifugal force, in which the solution portion collide with the solvent?? and collected. In the tank 72, the mist of the resist does not float around very much, and therefore the stuffing of the exhaustion opening **72*b* and the pipe 76 with a solidified resist portion does not substantially occur. Even if the pipe is stuffed with a solidified resist portion, the cleaning of the exhaustion opening 72*b* and the pipe 76** is very simple.

The rotation speed of the spin chuck 52, that is, the rotation speed of the drive motor 54, is controlled by the spin chuck rotation control portion 84 under the control of a system controller (not shown). The spin chuck rotation control portion 84 is made of a servo controller, and serves to control the speed of the drive motor 54 so as to have a smooth curved characteristic along with time, for example, an S-shaped curve, when the rotation of the spin chuck 52 is started or stopped, as can be seen in, for example, FIG. 12. In this manner, at a transition point of the rotation speed, an acceleration applied to the spin chuck 52 and the wafer W is small, and a sliding between them does not easily occur, thus preventing the generation of particles.

The resist nozzle 86 used for supplying a resist solution on the surface of a wafer W, is connected to a resist supply portion (not shown) via a resist supply tube 88. The resist nozzle 86 is detachably mounted to the distal end of the resist nozzle scan arm 92 at the resist nozzle standby unit 90 provided outside the cup 100, and conveyed to a predetermined resist solution discharge position set above the spin chuck 52. The resist nozzle scan arm 92 is mounted to the upper end portion of the vertical supporter member 96 which can be horizontally moved on a guard rail 94 laid on the unit bottom plate 50 in one direction (Y direction), and the arm can be moved in the Y direction integrally with the vertical supporter member 96 by a Y direction drive mechanism (not shown). Further, the resist nozzle scan arm 92 is movable also in an X direction normal to the Y direction in order to selectively mount the resist nozzle 86 at the resist nozzle standby unit 90, by means of an X direction drive mechanism.

In the resist application unit (COT) of the present embodiment, the discharge opening of the resist nozzle 86 is inserted to the opening **90*a* of the solvent atmosphere chamber at the resist nozzle standby unit 90, and therefore the tip end of a nozzle is exposed to the atmosphere of the solvent in the chamber, thus preventing the solidification or the deterioration of the resist solution at the tip end. Further, a plurality of resist nozzles 86** are provided, and each nozzle can be separately used in accordance with each of various types of resist solutions.

At the resist nozzle standby unit 90, according to its design, a plurality of resist nozzles 86 are arranged at a constant interval P, and the resist nozzle scan arm 92 moves at a pitch P' which corresponds to the interval 92 in order to pick up each resist nozzle. However, during the manufacture thereof or installation, the interval P between the resist nozzles 86 in some cases, drifts from what it should be. According to the present embodiment, in accordance with an error in the resist nozzle interval P, the movement pitch P' of the resist nozzle scan arm 92 is finely adjusted. For example, in the case where a pulse motor or a stepping motor is used as the drive motor for the X-direction drive mechanism, the number of pulses applied to the motor is adjusted by means of a software, in order to finely adjust the movement pitch P'.

Figure 13:
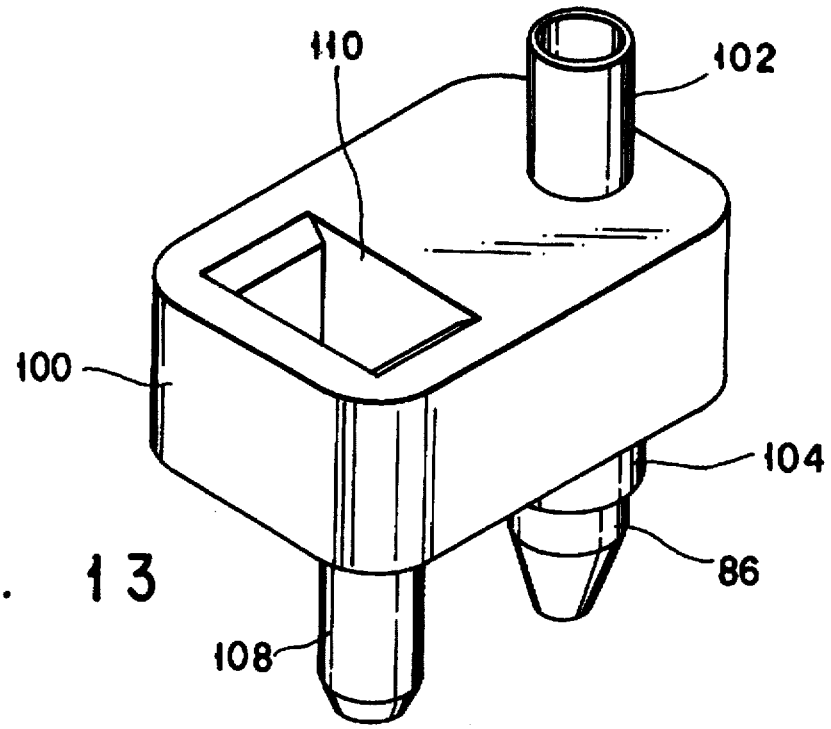
FIG. 13 is a perspective diagram showing the structure of the nozzle holder in the resist application unit of the embodiment of the present invention.
Figure 14:
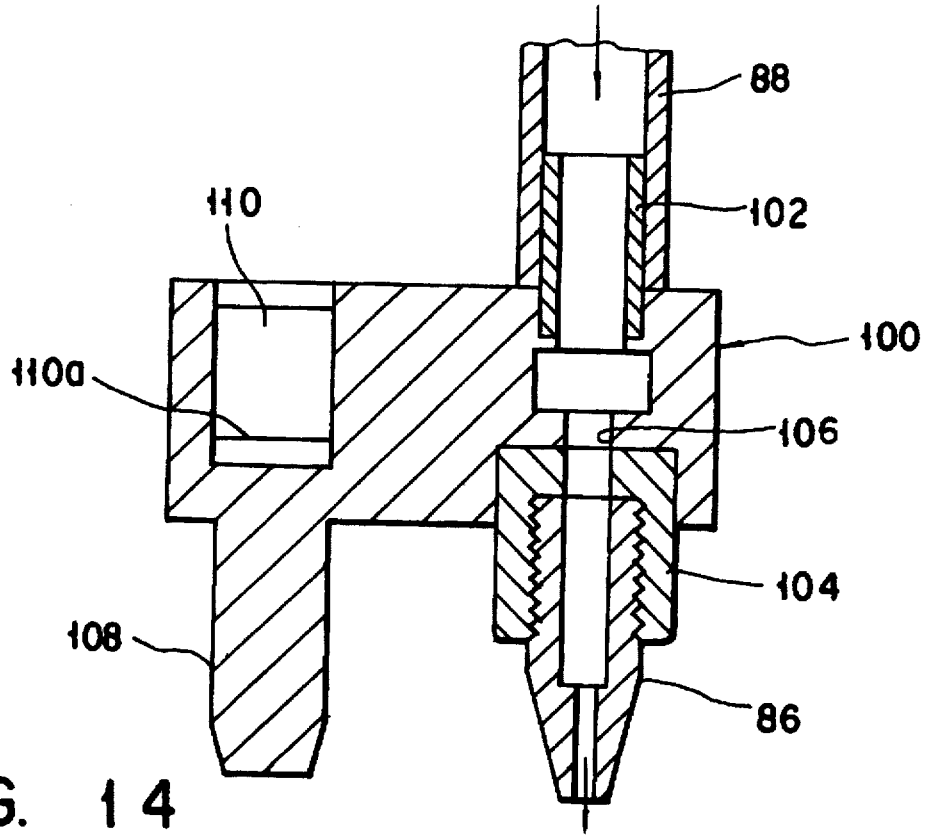
FIG. 14 is a cross section showing the structure of the nozzle holder in the resist application unit of the embodiment of the present invention.
Figure 15:
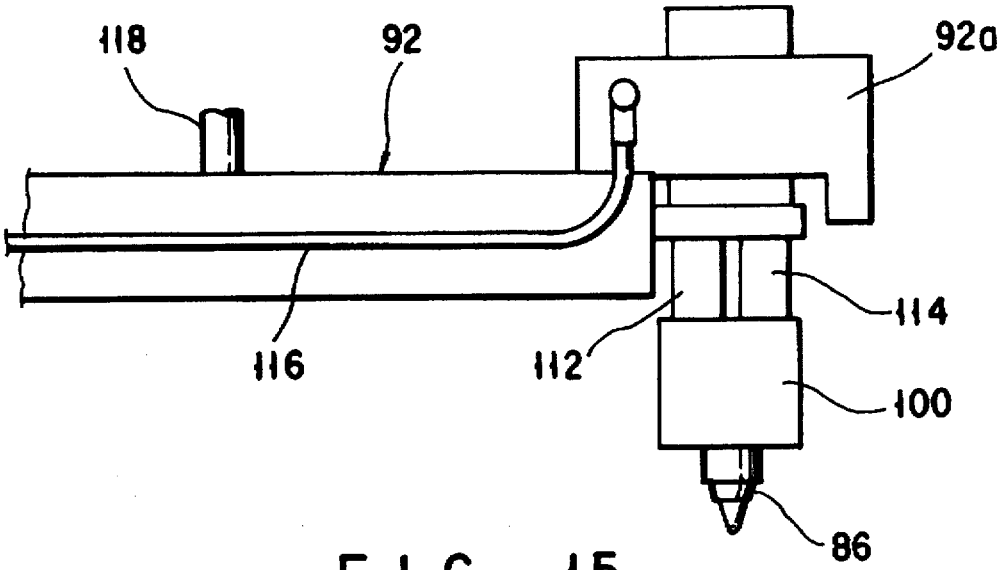
FIG. 15 is a cross section showing the state in which the resist nozzle is set on the rinse nozzle scan arm in the resist application unit of the embodiment of the present invention.
Figure 16A:
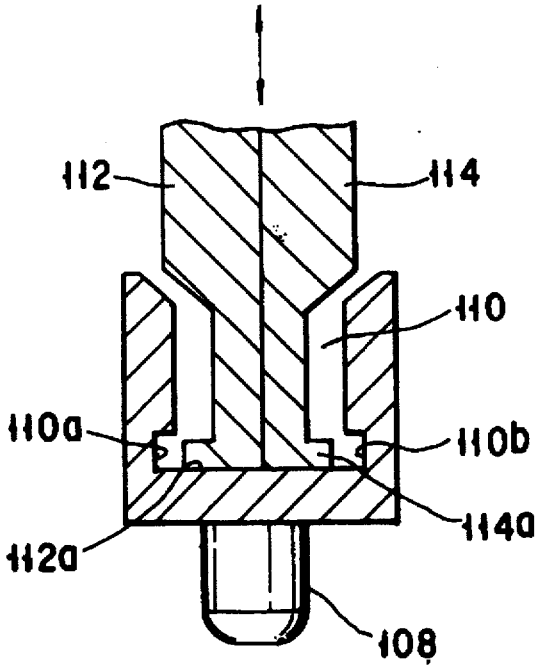
FIGS. 16A and 16B are cross sections showing the structure of the joint mechanism between the resist nozzle scan arm and the nozzle holder, in the resist application unit of the embodiment of the present invention.
Figure 16B:
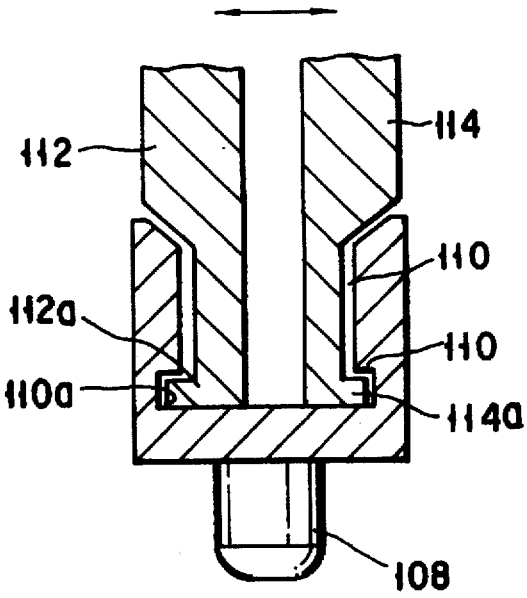

With reference to FIGS. 13 to 16B, the structure of the present embodiment, for detachably mounting the resist nozzle 86 to the resist nozzle scan arm 92, will now be described. FIGS. 13 and 14 are a perspective view and a cross section, respectively, showing the structure of the nozzle holder 100 for holding the resist nozzle 86. FIG. 15 is a side view showing the state in which the resist nozzle 86 is mounted on the tip end portion of the arm of the resist nozzle scan arm 92. FIGS. 16A and 16B are partial cross sections showing the structure of the joint mechanism between the resist nozzle scan arm 92 and the nozzle holder 100.

As can be seen in FIGS. 13 and 14, the nozzle holder 100 is made of a thick plate member. On an upper surface and a lower surface of the plate member, a cylindrical pipe mounting portion 102 and a nozzle mounting portion 104 are respectively fixedly attached, and the mounting portions 102 and 104 are connected via a through hole 106. The resist nozzle 86 is screwed on the nozzle mounting portion 104, and the resist supply tube 88 is fit to the pipe mounting portion 102. Further, on the lower surface of the nozzle holder 100, a rod-like fixation member 108 to be fixedly fit to a fixation holder hole **90*b* of the resist nozzle standby unit 90, and on the upper surface which is located on the opposite side of the fixation member 108, a recess portion 110 for accepting the tweezers 92*a* and 92*b* of the resist nozzle scan arm 92 is provided. On the inner wall surface of the bottom portion of the recess 110, a pair of grooves 110*a* and 110*b* which face to each other are formed as can be seen in FIGS. 16A and 16B**.

As can be seen in FIG. 15, a pair of openable tweezers 112 and 114 are mounted to a tweezer open/close drive mechanism (not shown) built in the tip end **92*a* of the resist nozzle scan arm 92. As shown in FIG. 16A, the tweezers 112 and 114 is designed to be able to enter the recess portion 110 of the nozzle holder 100 while they are in a closed position. At the tip ends of the tweezers 112 and 114, nail portions 112*a* and 114*a* are formed. As can be seen in FIG. 16B, when the tweezers 112 and 114 are opened within the recess portion 110, the nail portions 112*a* and 114*a* are fit or engaged with the groove portions 110*a* and 110*b* of the recess portion 110, so as to set or joint the nozzle holder 110 to the resist nozzle scan arm 92. Thus, the resist nozzle 86 is mounted. In order to detach the resist nozzle 86, the tweezers 112 and 114 are closed as can be seen in FIG. 16A, and pulled out. It should be noted that in FIG. 15, a reference numeral 116** indicates a cable for supplying a drive current to the tweezer open/ close drive mechanism in the tip end portion 92*a* of the arm, and a reference numeral indicates a pipe for discarding dust pieces in the arm by suction.

As described above, according to the present embodiment, in the recess portion 110 formed in the upper surface of the nozzle holder 100 for holding a resist nozzle 86, the groove portions (the first joint portions) 110*a* and 110*b* in the recess portion 110 and the nail portions 112*a* and 114*a* (the second joint portions) at the tip ends of the tweezers 112 and 114 of the resist nozzle scan arm 92 are fit with each other, and thus the resist nozzle 86 is detachably set to the resist nozzle scan arm 92. Even if both joint portions 110*a*, 110*b*, 112*a* and 114*a* are slid on each other, generating particles, when the setting or removing of the resist nozzle 86, the particles are confined in the bottom of the recess portion 110 and not scattered around. It is also possible to provide a suction opening (not shown) around the tweezers 112 and 114, so as to suck in the generated particles from the suction opening, and discard through the pipe 118.

As shown in FIG. 11, a vertical supporting member 122 which is movable in the Y direction and supports not only the vertical supporting member 96 for supporting the resist nozzle scan arm 92, but also the rinse nozzle scan arm 120, is also provided on the guide rail 94. At the tip end portion of the rinse nozzle scan arm 120, a rinse nozzle 124 for side rinse is mounted. The rinse nozzle scan arm 120 and the rinse nozzle 124 are allowed to move translationally or linearly between the nozzle standby position (indicated by a solid line) set on a side of the cup CP by the Y-direction drive mechanism (not shown) and the rinse solution discard position (indicated by a dotted line) set directly above the periphery portion of the wafer W placed on the spin chuck 52. A servo type positioning member may be provided for the Y-direction drive mechanism for the rinse nozzle scan arm 120. Since the positioning is carried out by a translational movement, even if an error occurs in the moving distance of the rinse nozzle scan arm 120 due to a backlash or the like, a further error which is worse than that which occurs in the moving distance error does not occur in the position of the rinse nozzle 122. Therefore, the rinse nozzle 122 is positioned at an accuracy which is practically sufficient. Consequently, the side rinse can be carried out on the periphery portion of the wafer always W at a constant width.

In FIG. 11, pipes (resist supply pipe 88 and rinse supply pipe) connected respectively to the resist nozzle 86 and the rinse nozzle 122 are not drawn in order to facilitate the illustration. Further, in FIGS. 10 and 11, a shutter mounted to the opening portion DR through which the wafer-conveying tweezers 24*a* enters the unit, is not drawn.

Figure 17:
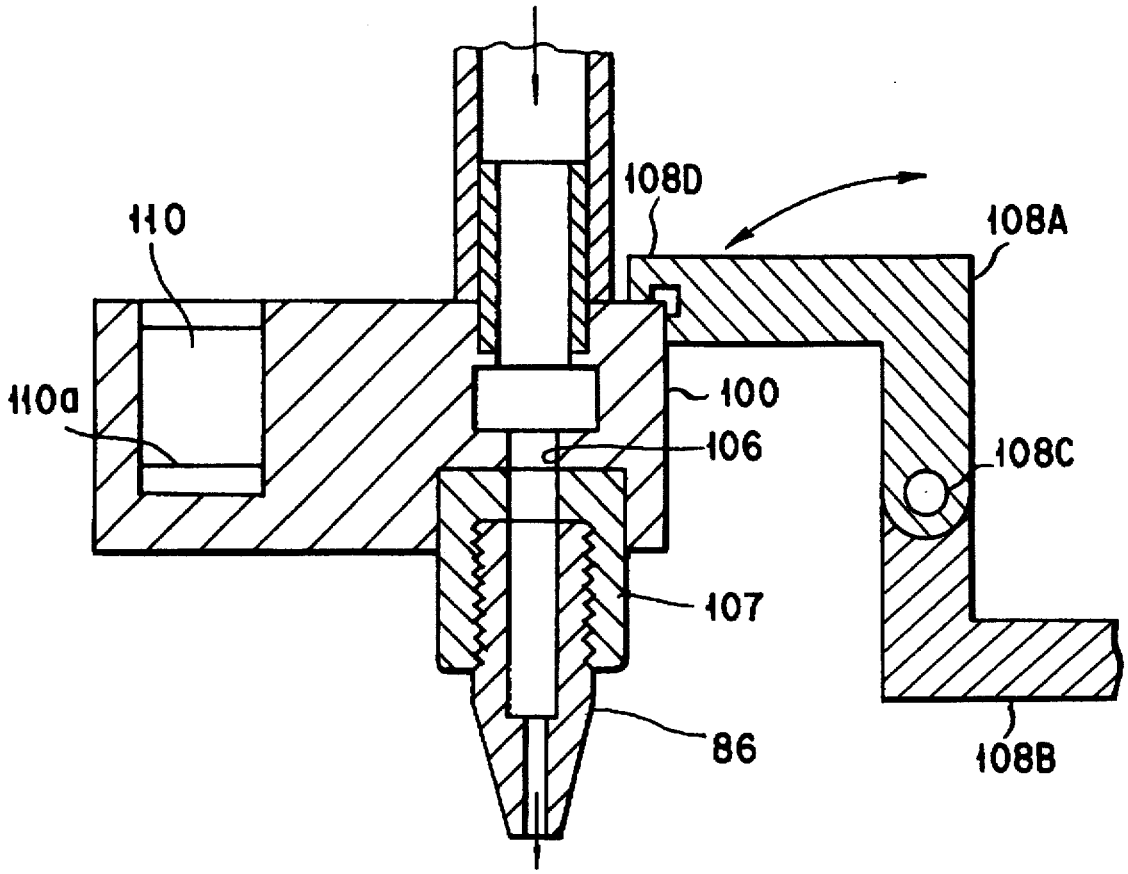
FIG. 17 is a cross section showing the structure of the fixation mechanism of the nozzle holder used in the resist application unit according to the embodiment of the present invention.

The structures or shapes of the members, or the circuit structures in the above embodiment are examples, and can be remodeled into a number of variations. For example, according to the above embodiment, the nail portions 112*a* and 114*a* are provided on the tweezers 112 and 114 of the arm 92, and the groove portions 110*a* and 110*b* are provided in the recess portion 110 of the nozzle holder 100 so that they are jointed with each other in the joint mechanism between the resist nozzle scan arm 92 and the nozzle holder 100; however it is also possible that, reversely, the groove portions are provided on the tweezers 112 and 114, and the nail portions or projections are provided in the recess portion, so as to joint them together. In the meantime, in place of using the projecting fixation member 108 in order to fix the nozzle holder 100 to the resist nozzle standby portion 90, it is also possible that the nozzle holder 100 is fixed to the resist nozzle standby unit 90 by means of a press member 108A as can be seen in FIG. 17. More specifically, a press member 108 having an L-letter shape, and formed rotatable around a rotation shaft 108C mounted to an end portion of a mounting member 108B fixed to the resist nozzle standby portion, is set, and the press member 108 is rotated as indicated by an arrow by means of a rotation mechanism (not shown) which uses an air cylinder, a motor or the like. In the standby state, the member 108A is rotated in the counter-clockwise direction, so as to press the upper end portion of the nozzle holder 100 by a tip end portion 108D, thus fixing the holder to the resist nozzle standby portion 90. When using the nozzle, the press member 108A is rotated in the clockwise direction, so as to render the nozzle holder in a removable state. When there are a plurality of nozzle holders 100, the press member 108A is provided for each of the holders 100, and the press members should be designed independently operable. Further, the above embodiment is directed to an apparatus for applying a resist solution to a wafer; however the present invention can be applied to an apparatus for applying a processing solution to a different object to be process.

As described above, according to the first coating apparatus of the present invention, the waste solution and the gas are separated in the storage means outside the cup used for collecting the processing solution scattered around when the solution is supplied to an object, and therefore, the cleaning of the cup is not necessary, improving the maintenance property.

Further, according to the second coating apparatus of the present invention, the cleaning air which is supplied in a down flow manner and the temperature of which is adjusted, is rendered detour underneath the cup, so that the cleaning air can be supplied to the rear surface of the object without being influenced by the heat generated from the drive means, thus making it possible to improve the quality of the application film.

The accompanying drawings, which are incorporated in and constitute a part of the specification, illustrate presently preferred embodiments of the invention and, together with the general description given above and the detailed description of the preferred embodiments given below, serve to explain the principles of the invention.

What is claimed is:

1. A processing apparatus using a solution, comprising:

means for holding an object to be processed, said means rotating with the object placed thereon;

a ring-shaped cup situated at an outer side of said object holding means;

processing solution supply means provided above said object for supplying a processing solution on a surface of said object;

discharging means provided below said ring-shaped cup for discharging, as a waste solution, together with air in said cup, processing solution portions scattered around when said processing solution is supplied on the surface of said object; and storage means connected to said discharge means for storing said waste solution and said gas discharged from said discharge means and for separating said waste solution and said gas from each other therein.

2. A processing apparatus according to claim 1, further comprising means for controlling a rotation of said object holding means, said controlling means comprising means for changing the rotation speed of said object holding means gradually.

3. A processing apparatus according to claim 1, including a holder having a recess portion in an upper surface thereof for holding said processing solution supply means, and means for conveying said processing solution supply means between a standby position thereof and a processing solution discharge position set above said object holding means, wherein a first joint is provided in said recess portion, and said processing solution supply means conveying means can enter and exit said recess portion in a vertical direction and includes a tweezer member having a second joint portion which can be jointed to said first joint portion within said recess portion.

4. A processing apparatus according to claim 1, further comprising a movable arm for supporting said processing solution supply means, and arm drive means for translationally moving said arm in order to convey said processing solution supply means between a standby position thereof and a processing solution discharge position set and above said object holding means.

5. A processing apparatus according to claim 1, wherein said storage means includes a solution surface detection means for detecting a solution surface of said waste solution.

6. A processing apparatus according to claim 1, wherein said storage means includes a gas discharge pipe for discharging said gas and a waste solution discharge pipe for discharging said waste solution.

7. A processing apparatus according to claim 6, wherein said gas discharge pipe is located above said waste solution discharge pipe.

8. A processing apparatus with use of a solution according to claim 1, further comprising means for creating a negative pressure in said storage means.

9. A processing apparatus using a solution, comprising:

means for holding an object to be processed, said object holding means having drive means for rotating said object holding means with the object placed thereon;

a ring-shaped cup situated on an outer side of said object holding means;

processing solution supply means, provided above said object, for supplying a processing solution on a surface of said object;

clean air supply means for allowing clean air, a temperature of which is adjusted, to flow to said ring-like cup and a surrounding area thereof, in a down-flow manner;

means mounted so as to cover at least a part of an outer side surface of said drive means for substantially preventing transfer of heat from said drive means; and clean air guide means for allowing said cleaning air to flow from an outer side of said ring-shaped cup to an inner side of said ring-like cup through an underneath portion of said ring-like cup, so as to supply said cleaning air to a rear surface of the object placed on said object holding means.

10. A processing apparatus according to claim 9, further comprising means for controlling a rotation of said object holding means, said controlling means comprising means for changing the rotation speed of said object holding means gradually.

11. A processing apparatus according to claim 9, including a holder having a recess portion in an upper surface thereof for holding said processing solution supply means and means for conveying said processing solution supply means between a standby position thereof and a processing solution discharge position set above said object holding means, wherein a first joint is provided in said recess portion, and said processing solution supply means conveying means can enter and exit said recess portion in a vertical direction and includes a tweezer member having a second joint portion which can be jointed to said first joint portion within said recess portion.

12. A processing apparatus according to claim 9, further comprising a movable arm for supporting said processing solution supply means, and arm drive means for translationally moving said arm in order to convey said processing solution supply means between a standby position thereof and a processing solution discharge position set above said object holding means.

13. A processing apparatus according to claim 9, further comprising temperature and moisture detecting means for detecting temperature and moisture of said cleaning air.

* * * * *